US006526992B2

(12) United States Patent
Bouix

(10) Patent No.: US 6,526,992 B2
(45) Date of Patent: Mar. 4, 2003

(54) FLOCKED COSMETIC SAMPLER, METHOD OF MAKING AND METHOD OF USE

(75) Inventor: Herve F. Bouix, New York, NY (US)

(73) Assignee: Color Access, Inc., Melville, NY (US)

( * ) Notice: Subject to any disclaimer, the term of this patent is extended or adjusted under 35 U.S.C. 154(b) by 0 days.

(21) Appl. No.: 09/882,460

(22) Filed: Jun. 14, 2001

(65) Prior Publication Data

US 2001/0027796 A1 Oct. 11, 2001

Related U.S. Application Data

(63) Continuation-in-part of application No. 09/359,950, filed on Jul. 22, 1999.

(51) Int. Cl.[7] ..... A45D 40/24; A45D 40/26
(52) U.S. Cl. ..... 132/318; 132/317; 132/320
(58) Field of Search ..... 132/318, 317, 132/320, 297, 293; 40/126; 424/60; 206/581; 220/4.27, 23.83, 23.4

(56) References Cited

U.S. PATENT DOCUMENTS 940,797 A * 11/1909 Fraser ..... 132/320
2,414,245 A * 1/1947 Rudd ..... 132/318
2,953,142 A * 9/1960 Clementson ..... 206/581
4,915,234 A * 4/1990 Boeller ..... 206/581
5,069,232 A * 12/1991 Staar ..... 132/318
5,636,931 A * 6/1997 Gueret ..... 401/126
6,010,266 A * 1/2000 Schrepf ..... 401/126
6,059,570 A * 5/2000 Dragan et al. ..... 433/80
6,062,235 A * 5/2000 Renna ..... 132/320
6,076,534 A * 6/2000 Gueret ..... 132/320

* cited by examiner

*Primary Examiner*—John J. Wilson
*Assistant Examiner*—Robyn Kieu Doan
(74) *Attorney, Agent, or Firm*—Peter Giancana; Martin Haerter

(57) ABSTRACT

A cosmetic sampler comprising a body and at least one applicator tip attached to the body, the applicator tip comprising an applicator surface and flocking. The flocking provides a surface that can receive a cosmetic product in an amount sufficient for one or two applications. Preferably, the individual bodies are stackable, the individual applicator tips are stackable and/or the assembled samplers are stackable. Optionally, a closure that covers the applicator tip and attaches to the body is included. The closure may provide either an ordinary or an airtight seal. Also, a method of making the cosmetic sampler comprising the steps of fabricating a hollow body, flocking a thermoformable substrate, thermoforming the flocked substrate into an applicator tip and attaching the applicator tip to the body. Alternatively, the applicator tip may be molded and then flocked and then attached to the body. Optionally, the method includes a step of injection molding a cap that is suitable to be fitted onto the body in either an ordinary or airtight seal.

21 Claims, 5 Drawing Sheets

FLOCKED COSMETIC SAMPLER, METHOD OF MAKING AND METHOD OF USE

This application is a continuation-in-part of co-pending application Ser. No. 09/359,950, which is filed on Jul. 22, 1999 incorporated herein, by reference, in its entirety.

FIELD OF THE INVENTION

This invention relates to cosmetic applicators. More specifically, the invention relates to cosmetic sampler applicators adapted for single or short-term use.

BACKGROUND OF THE INVENTION

In an effort to get consumers to commit to the purchase of a makeup product, the cosmetics vendor frequently invites the consumer to sample the product on the consumer's own skin. In so doing, the cosmetics vendor must provide the consumer with an amount of product adequate to make an informed decision while keeping the cost of this sampling as low as possible. Frequently, the standard procedure is to have on hand at the cosmetics counter, an array of full sized pieces of each color in the makeup line, designated as "testers". In this scenario, every prospective buyer samples from the same tester, for example, a full sized lipstick. In the case of lipsticks no buyer is permitted to apply the tester directly to her lips, for obvious hygienic reasons. At best the customer may stroke the lipstick on the back of her hand. On the other hand, if the product is an eyeshadow, for example, then an individual cotton swab might be provided to each customer to allow each customer to sample from the same piece. Clearly, such sampling procedures are less than optimal for the consumer, because they do not permit normal application and evaluation of the appearance of the product in the environment in which it will be worn.

One alternative to full sized testers are single-use or short-term use samplers. The single-use sampler is completely hygienic, being used by a single consumer. The single-use sampler allows the consumer to apply a lipstick directly to her lips, either at the counter or at home, where she may try the product with a particular clothing outfit or in combination with other cosmetics. The single use sampler has become an established method of sampling, being preferred by the vendor and the consumer as a means of evaluating a new product. Illustrations of such samplers are found, for example in U.S. Pat. Nos. 5,785,905 and 4,915,234 and International patents nos. WO96/32013 and WO96/32032. These samplers, however, have problems. For example, because each sampler is only used once, the vendor must keep at the counter a large inventory of samplers in each shade. This creates a storage problem in a small space. It is also very costly to make so many samplers, some of which will have to be discarded if they are not used within a certain time period. Furthermore, if the product to be sampled contains a volatile component, that is, a component that evaporates quickly, then those samplers will require airtight packaging, which is a further expense. So while these samplers address the need for a hygienic method of sampling cosmetic products, they remain impractical for the reasons stated. In fact, these samplers created problems that did not exist when sampling from a full sized piece. There remains, then, a need for a cosmetic sampler that affords the consumer a convenient means of trying new products under hygienic conditions, while at the same time being cost effective and space efficient for the vendor. The present invention provides such a sampler.

SUMMARY OF THE INVENTION

The present invention is a cosmetic sampler comprising a body and at least one applicator tip attached to the body, the applicator tip comprising an applicator surface and flocking. The flocking provides a surface that can receive a cosmetic product in an amount sufficient for one or two applications. Preferably, the individual bodies are stackable, the individual applicator tips are stackable and/or the assembled samplers are stackable. Optionally, a closure that covers the applicator tip and attaches to the body is included. The closure may provide either an ordinary or an airtight seal. The invention is also directed to a method of making the cosmetic sampler comprising the steps of fabricating a hollow body, flocking a thermoformable substrate, thermoforming the flocked substrate into an applicator tip and attaching the applicator tip to the body. Alternatively, the applicator tip may be molded and then flocked and then attached to the body. Optionally, the method includes a step of injection molding a cap that is suitable to be fitted onto the body in either an ordinary or airtight seal.

DETAILED DESCRIPTION OF THE INVENTION

Figure 1:
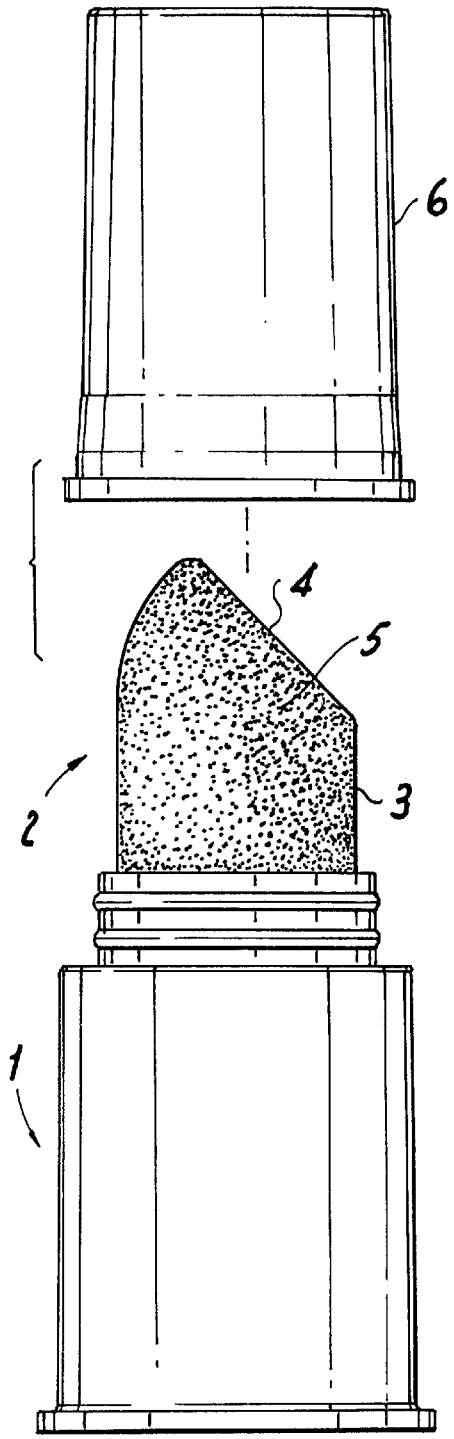
FIG. 1 is an elevation view of the sampler of the invention.
Figure 2:
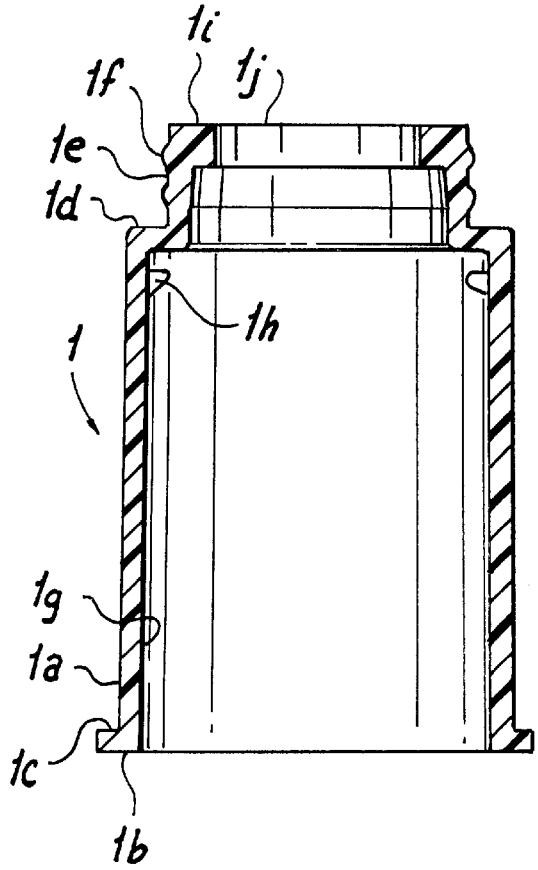
FIG. 2 is a section view of the sampler body.

As shown in FIG. 1, the sampler comprises two distinct regions, a body (1) and an applicator region (2). Referring to FIG. 2, the body (1) has an outside surface (1*a*) which is that part of the sampler that the user grips with her hand. The outside surface may be any shape and the body may be hollow or solid. The base (1*b*) of the body may be opened or closed. Preferably, the body has a generally cylindrical outside surface, is hollow and has an opened base. The outside surface is preferably tapered such that many hollow bodies can be stacked, one body partly inside of another body. Here and throughout, stacked and stackable mean that identical elements are capable of being vertically arranged such that one element is partly inside another element. The ability to stack parts in this way will increase space efficiency in both shipping and storing the components. The outside surface of the body may be provided with a circumferential flange (1*c*), adjacent to the base, that provides stability against tipping over. The outside surface of the body may support a neck finish (1*e*). Optionally, there may be a first step-in (1*d*) disposed between the outside surface and the neck finish. The neck finish and step are part of the body. The neck finish is opened at both ends and may be suitable for receiving a closure. To that end the outside surface of the wall may be provided with raised elements and/or recessed elements (1*f*) that provide friction against the inside of the closure that slides over the neck finish. The raised elements may be, for example, a series of vertical ribs or one or more circumferential rings or threads that cooperatively engage threads located inside the closure. The recessed elements may be, for example, circumferential grooves or dimples. For the purposes of this invention, these raised and recessed elements may be referred to as friction elements. The inside surface of the body (1*g*) may be provided with one or more raised fitments (1*h*). The top of the neck finish on its inside surface may have a second step-in (1*i*) that defines the top opening (1*j*) of the body.

The body (1) of the sampler is preferably fabricated out of one or more plastics suitable for the molding technique to be used. Each plastic will provide its own texture and feel in the hand of the user and this factor will also affect the choice of plastic. The body is preferably injection molded out of polypropylene, low or high density polyethylene or olefins. Other suitable molding techniques for the body include, but are not limited to thermoforming, roll forming and vacuum forming. Alternatively, the body may be fabricated out of metal by stamping. The body may be provided with features that enhance the feel and or grip of the consumer. For example, the body may have recesses for receiving the finger tips of the user which would provide a firmer grip for the user. The body may be overmolded with a soft touch material, such as a deformable elastomer. The body may be provided with a rough texture to enhance gripping. Many other variations will be apparent to one skilled in the art.

Figure 3:
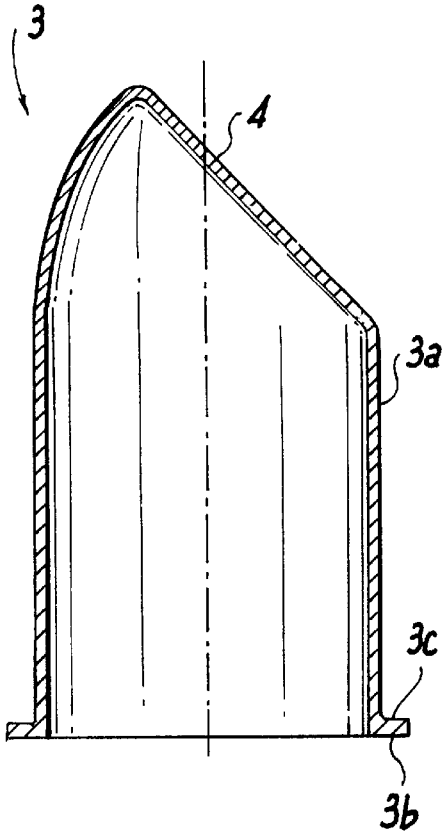
FIG. 3 is a section view of the applicator tip.

Referring to FIG. 3, the applicator tip (3) has an outside surface (3*a*). The outside surface may be any shape and the tip may be hollow or solid. The base (3*b*) of the applicator tip may be opened or closed. Preferably, the applicator tip has a generally cylindrical outside surface, is hollow and has an opened base. The outside surface is preferably tapered such that many hollow tips can be stacked, one tip partly inside of another tip. The ability to stack parts in this way will increase space efficiency in both shipping and storing the components. The outside surface of the applicator tip may be provided with a circumferential flange (3*c*), adjacent to the base. In the illustrations, the applicator tip is in the shape of a lipstick pomade, however it will be understood that the applicator tip may be in any shape that is convenient for taking up and depositing product onto the user's skin. For example, the cross section of the applicator tip may be round, rectangular, hexagonal or triangular.

The application surface (4) is that portion of the tip (3) which is particularly shaped and adapted to receive a quantity of cosmetic and deliver at least a portion of cosmetic to the user's skin. The application surface may be round, oval, square, tear drop shaped, heart shaped or any other shape that permits application of the makeup product to the skin. The application surface may comprise only a portion of the surface of the applicator tip or substantially all of the surface of the applicator tip. The application surface and perhaps some portion of the applicator tip have flock (5) thereon. The choice of how much of the tip is covered by flock depends on the desired appearance of the sampler and the method of manufacture. Preferably, sheets of the tip substrate material are flocked first and then the material is molded and cut into a plurality of individual tips. When flocking the substrate before molding, it is preferable to spot flock. Spot flocking means that flock fibers are applied to discrete regions of the substrate. After molding, those flocked regions will comprise at least the applicator tip. Spot flocking may be achieved by known methods such as silk screening an adhesive onto the substrate in a desired pattern. Alternatively, the substrate may be completely covered in flock. When manufactured this way, the entire applicator tip will be covered with flock. Alternatively, the tips may be molded first and then the flock is applied, either just on the application surface or also on the some other portion of the applicator tip.

The order of flocking and molding affects the molding processes that are suitable, which in turn affects the choice of material that may be used for the tip. In the preferred embodiment, the tip is made by thermoforming. In this case, the tip material is polystyrene substrate provided in flat sheets, but any thermoformable material may be used. The sheet is first flocked by standard flocking techniques. Preferably the flocking is carried out in an a manner that orients the flock fibers uniformly, such as in an electric field. Nylon and rayon flockings are suitable for this purpose. After flocking, the polystyrene sheet is thermoformed by heating and then contacting a plurality of "male" dies against the softened, flocked substrate. In this way the sheet now comprises a plurality of applicator tips which are separated from each other by cutting and trimming the material to a size that will fit into the body (1). The advantage of flocking first and then molding is that it is more economical and easier to control the flocking of a single two dimensional sheet surface than to control the flocking of hundreds of small three dimensional surfaces. Alternatively, if the tip (3) is first molded and then flocked, then suitable molding techniques include injection molding, thermoforming, vacuum forming, stamping. Suitable materials include thermoformable and non-thermoformable plastics and metal.

Figure 4:
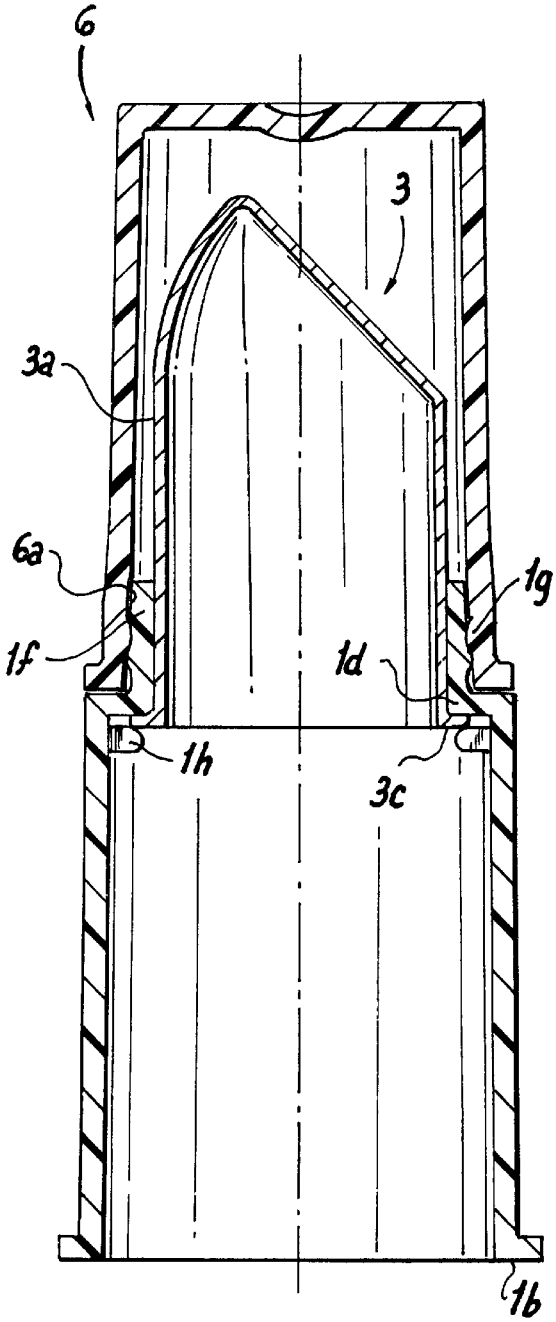
FIG. 4 is an axial section though the sampler with a cap in place, with a detailed view of the articulation of the cap with a body.
Figure 5:
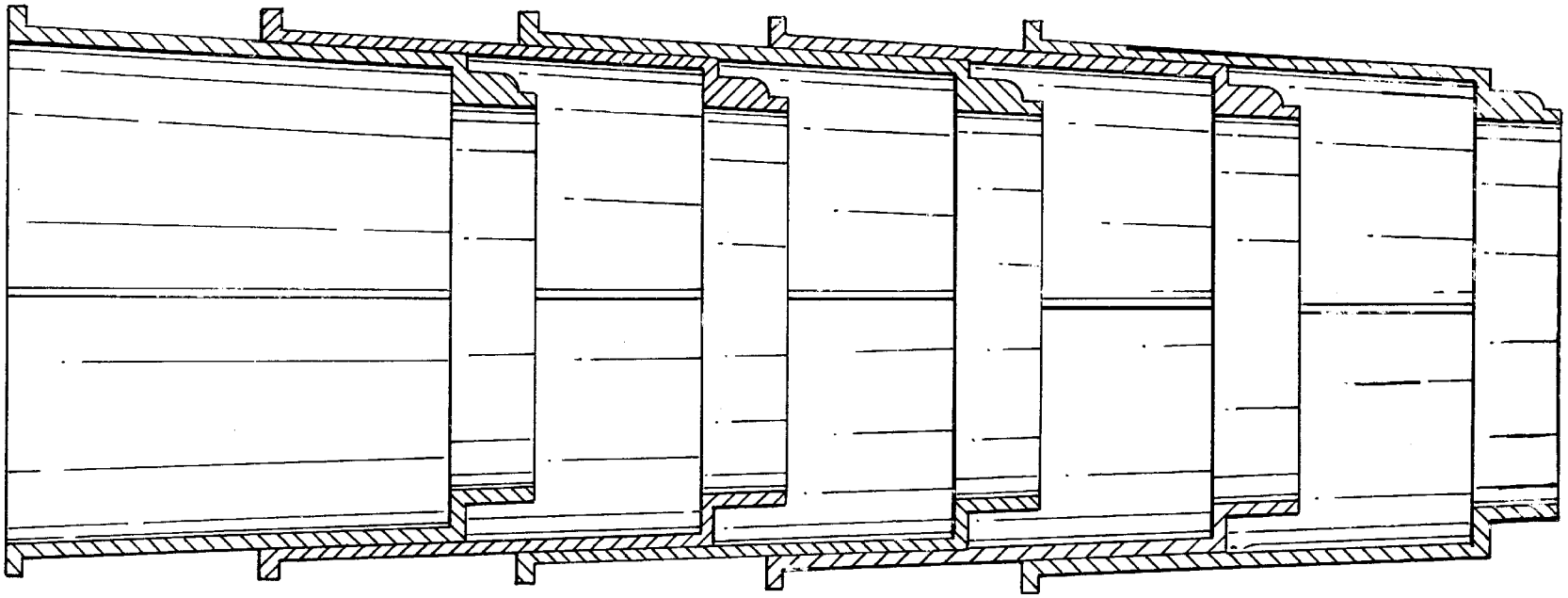
FIG. 5 is a cross section and elevation of a plurality of stacked hollow bodies.
Figure 6:
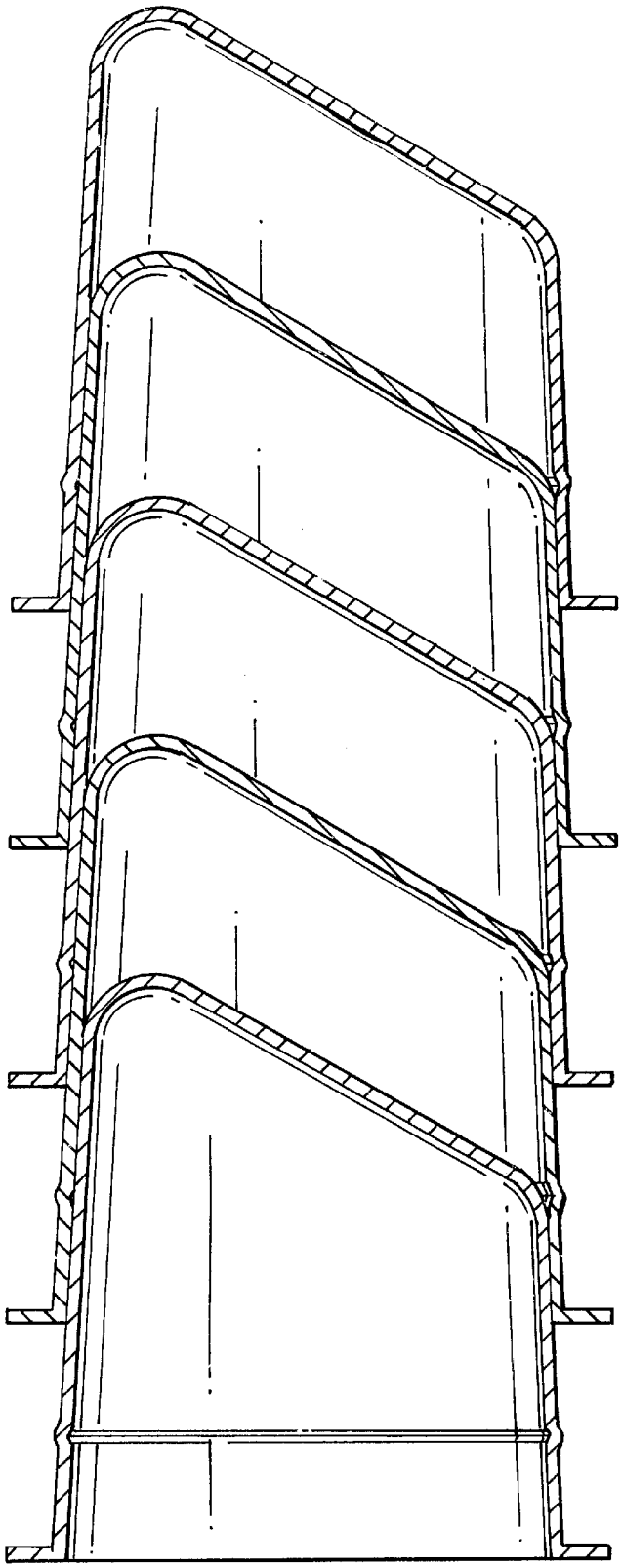
FIG. 6 is a cross section and elevation of a plurality of stacked hollow applicator tips.
Figure 7:
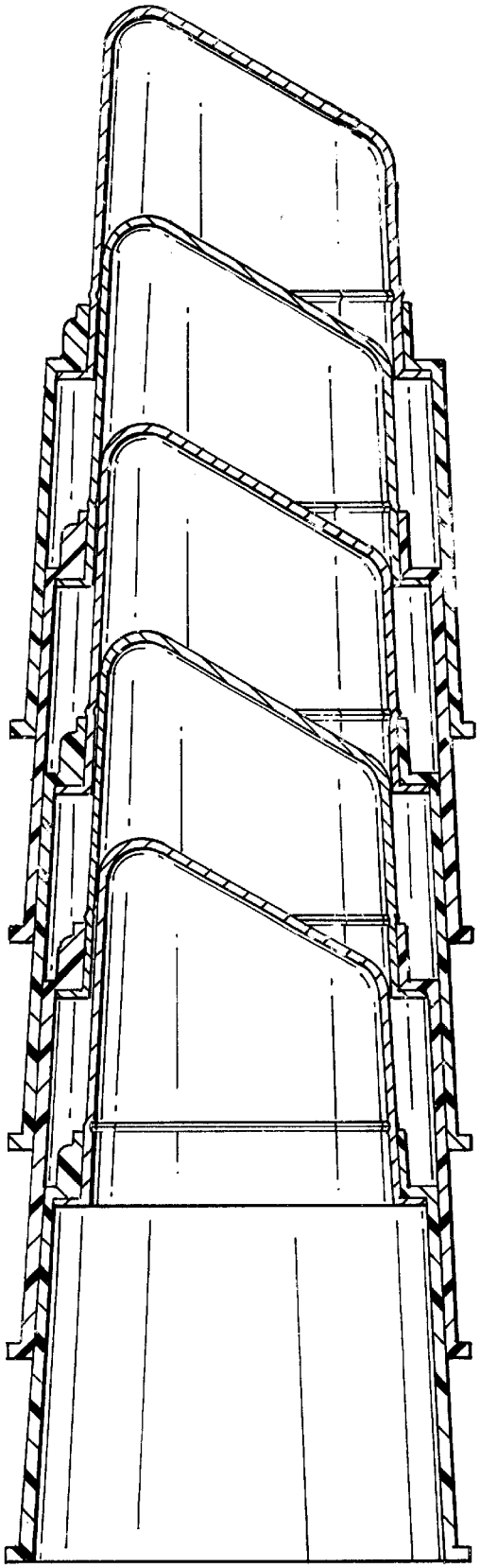
FIG. 7 is a cross section and elevation of a plurality of stacked, assembled cosmetic samplers.

The body and the tip are separate as so far described, and must be assembled to form a sampler. FIG. 4 shows the applicator tip assembled to the body. The tip is inserted through the base (1*b*) of the body and made to protrude out of the top opening (1*j*). The tip is inserted until the flange (3*c*) of the tip rests against either the first (1*d*) or second (1*i*) step-in of the body. The tip is prevented from backing out of the body by friction between the outside surface (3*a*) of the tip and the inside surface (1*g*) of the body. Optionally, the tip is further prevented from backing out of the body by the at least one raised fitment (1*h*), which the flange (3*c*) was forced over in assembly.

Up to now, the body (1) and the tip (3) have been described as two separate pieces requiring assembly, but they may also be integrally molded as a single unit. For the purposes of this invention, integrally molding means that the body and the applicator tip are chemically bonded directly together, that is, with no intervening medium. When molded as a single unit, the molding may be done first, by any suitable means, and then the flock may be applied to the desired portion of the applicator tip. Alternatively, a sheet of substrate may be flocked first and then the flocked sheet is molded into a sampler. When flocking the substrate before molding, it is preferable to spot flock, as described above. Alternatively, the substrate may be completely covered in flock. In this case, after molding, both the body and applicator tip would have flock fibers attached.

As discussed, either or both of the body (1 ) and the applicator tip (3) may be hollow. If both elements are hollow, then it is preferable to be able to stack the assembled samplers, one sampler partly inside another sampler. Of course, if these elements are hollow and stackable, then they require much less material, are less expensive to manufacture, have less impact on the environment when disposed and require less space for storage.

In one embodiment, and as shown in FIG. 4, the sampler is provided with a closure (6), to protect the flocked applicator tip (3). This is beneficial, either to keep dust off of the flocking or to prevent cosmetic product from being exposed to the air. Also, if the customer wishes to take the sampler from the cosmetics counter for later use, then it is important to provide a closure to preserve the product on the flock (5) and to prevent the product from contacting clothing or other surfaces. The inside surface of the closure may have the same type of frictional elements as the neck finish discussed above. In this way, an ordinary seal or an airtight seal may be achieved. For example, an ordinary seal may be achieved when the frictional elements are a series of spaced apart vertical ribs located on either the neck finish or the closure. Alternatively, an airtight seal may be achieved when the frictional elements are one or more circumferential rings that are continuous around the neck finish. The circumferential rings may fit into corresponding internal annular grooves (6*a*) of the closure, securing the cap in place on the body. Alternatively, the closure and neck finish of the body may be provided with cooperating threads for a screw type engagement. Alternatively, if the neck finish has been provided with recessed elements as discussed above, then the closure may have corresponding raised elements designed to snap-fit into those recessed elements. For example, the neck finish may have circumferential grooves and the closure inner surface may have raised circumferential rings. The closure may be made by any suitable means. Preferably, the closure is injection molded from polypropylene, high or low density polyethylene or acetal. Other suitable molding methods include, but are not limited to thermoforming, vacuum forming or stamping out of metal.

The sampler of the present invention is particularly well adapted for use in providing samples of lipstick, lip gloss and other lip products. However, its use is not limited in this way and the sampler may be used for sampling eyeshadow, blushes, eyebrow products, foundations, face powders, skin care products, etc. Any type of product that can be conveniently transferred to and held by the flock can be used with the present invention. In use, the sampler is provided to the counter empty, i.e., without any product on the flock. When a customer expresses interest in a particular product and a particular shade, the beauty adviser simply applies the product of interest by contacting the flocked applicator tip and the product, either by immersing the tip into the product or by rubbing the flocked tip against the product. The flock holds enough product for one or two applications of the product. The flocked tip, now loaded with product, is rubbed against that potion of the skin where it is desired to apply the cosmetic.

The sampler of the present invention is completely hygienic because each user receives her own sampler and the source of product has not been contaminated by coming into contact with the consumer. The consumer may try many products while generating very little wasted product. A single full sized unit can provide the product for many samples or the product may be drawn from a non-saleable package such as a jar. In this way, the more costly full sized units are not unnecessarily depleted. The sampler is inexpensive to make and gives the consumer adequate product to try, either at or away from the cosmetics counter. The amount of storage space required is minimal and much less than needed for existing sampler devices.

What is claimed is:

1. A cosmetic sampler comprising:

a hollow body having an inside surface, an outside surface and a base;

a stackable hollow applicator tip attached to the body, having an outside surface and a base, the outside surface comprising an application surface and being tapered such that a plurality of hollow applicator tips can be vertically stacked, one applicator tip partly inside another applicator tip; and flock fibers disposed on at least some of the outside surface of the applicator tip.

2. The sampler of claim 1 wherein the outside surface of the body is tapered such that a plurality of hollow bodies can be vertically stacked, one body partly inside another body.

3. The sampler of claim 1 wherein the body further comprises a circumferential flange adjacent to the base of body.

4. The sampler of claim 1 wherein the body further comprises a neck finish that is opened at both ends and has an inside surface and an outside surface.

5. The sampler of claim 4 wherein the neck finish has friction elements on its outside surface.

6. The sampler of claim 5 wherein the friction elements of the neck finish are vertical ribs, or circumferential rings or screw threads or grooves or dimples.

7. The sampler of claim 4 wherein the body further comprises at least one step-in.

8. The sampler of claim 7 wherein the body has at least one raised fitment on the inside surface of the body.

9. The sampler of claim 1 wherein the body further comprises recesses for receiving the fingers of the user.

10. The sampler of claim 1 further comprising a soft touch material disposed on the outside surface of the body.

11. The sampler of claim 8 wherein the applicator tip further comprises a circumferential flange adjacent to the base of applicator tip, such that when the applicator tip is attached to the body the flange is located between the at least one step of the body and the at least one fitment of the body.

12. The sampler of claim 1 wherein the flock fibers are uniformly oriented.

13. The sampler of claim 12 wherein the flock fibers are nylon or rayon.

14. The sampler of claim 4 further comprising a closure that has frictional elements on its inside surface.

15. The sampler of claim 14 wherein the friction elements of the closure are vertical ribs, or circumferential rings or screw threads or grooves or dimples.

16. A method of making a cosmetic sampler comprising the steps of:

(a) fabricating a hollow body that has an outside surface;

(b) fabricating a flocked applicator tip that has an application surface, comprising the steps of flocking a thermoformable substrate;

thermoforming the flocked substrate into an applicator tip having an application surface; and (c) attaching the applicator tip to the body.

17. The method of claim 16 wherein step of fabricating the hollow body is fabricated by one of injection molding or thermoforming or roll forming or vacuum forming.

18. The method of claim 16 wherein the flocking of the substrate is carried out in a manner that orients the flock fibers uniformly.

19. The method of claim 18 wherein the flock fibers are nylon or rayon.

20. The method of claim 16 wherein the step of thermoforming the flocked substrate into an applicator tip comprises the steps of heating the substrate and then contacting a plurality of "male" dies against the softened, flocked substrate.

21. A method of making an applicator tip comprising the steps of:

(a) flocking a thermoformable substrate; and (b) thermoforming the flocked substrate into an applicator tip having an application surface by heating the substrate and then contacting a "male" die against the softened, flocked substrate.

* * * * *